US010492564B1

(12) United States Patent
Dean

(10) Patent No.: US 10,492,564 B1
(45) Date of Patent: Dec. 3, 2019

(54) FOOTWEAR CONSTRUCTION

(71) Applicant: Wolverine Outdoors, Inc., Rockford, MI (US)

(72) Inventor: Martin W. F. Dean, Hertfordshire (GB)

(73) Assignee: Wolverine Outdoors, Inc., Rockford, MI (US)

( * ) Notice: Subject to any disclaimer, the term of this patent is extended or adjusted under 35 U.S.C. 154(b) by 99 days.

(21) Appl. No.: 15/978,753

(22) Filed: May 14, 2018

(51) Int. Cl.

| | |
|---|---|
| ***A43B 13/18*** | (2006.01) |
| ***A43B 7/14*** | (2006.01) |
| ***A43B 7/32*** | (2006.01) |
| ***A43B 13/14*** | (2006.01) |
| ***A43B 13/16*** | (2006.01) |
| ***A43B 3/00*** | (2006.01) |

(52) U.S. Cl.
CPC ..... *A43B 13/184* (2013.01); *A43B 3/0042* (2013.01); *A43B 7/142* (2013.01); *A43B 7/144* (2013.01); *A43B 7/145* (2013.01); *A43B 7/32* (2013.01); *A43B 13/141* (2013.01); *A43B 13/16* (2013.01); *A43B 13/186* (2013.01)

(58) Field of Classification Search
CPC ... A43B 3/0042; A43B 13/184; A43B 13/141; A43B 13/186; A43B 13/16
See application file for complete search history.

(56) References Cited

U.S. PATENT DOCUMENTS 4,314,220 A 2/1982 Ito et al.
5,077,916 A * 1/1992 Beneteau ..... A43B 13/184 36/128
5,367,791 A * 11/1994 Gross ..... A43B 13/181 36/25 R
D380,889 S 7/1997 Earle
D389,993 S 2/1998 Ryan
D393,538 S 4/1998 Marshall
D394,343 S 5/1998 Marshall et al.
D394,541 S 5/1998 Burgess
D394,741 S 6/1998 Gaudio
(Continued)

OTHER PUBLICATIONS

Image downloaded from https://sneakernews.com/wp-content/uploads/2016/06/adidas-eqt-integral-feet-you-wear_.jpg on May 1, 2018.
(Continued)

*Primary Examiner* — Ted Kavanaugh
(74) *Attorney, Agent, or Firm* — Warner Norcross + Judd LLP

(57) ABSTRACT

A sole assembly is provided including multiple compression units entrapped in a midsole and adjacent an outsole to efficiently distribute forces and to assist in correct foot motion during a gait cycle. The multiple compression units can be linked to one another to assist the foot in moving through an appropriate foot motion during a gait cycle. A heel compression unit can be linked to an arch compression unit, which can be linked to one or more forefoot compression units, which can be linked to a toe compression unit. The linking of the heel compression unit, the arch compression unit, and the forefoot compression unit to one another can resist torsional movement of the units between one another, thereby providing a more stable foot support, while still providing impact-attenuation and force distribution through the sole assembly.

20 Claims, 6 Drawing Sheets

(56) References Cited

U.S. PATENT DOCUMENTS

| | | | | |
|---|---|---|---|---|
| D395,743 | S | 7/1998 | Ryan | |
| D404,897 | S | 2/1999 | Marshall | |
| D407,892 | S | 4/1999 | Gaudio | |
| 5,915,820 | A | 6/1999 | Kraeuter et al. | |
| D411,910 | S | 7/1999 | Cessor | |
| D412,050 | S | 7/1999 | Chassaing | |
| 6,119,373 | A | 9/2000 | Gebhard et al. | |
| D432,762 | S | 10/2000 | Weege | |
| 6,266,897 | B1 | 7/2001 | Syedel et al. | |
| 6,438,873 | B1 | 8/2002 | Gebhard et al. | |
| 6,516,540 | B2 | 2/2003 | Seydel et al. | |
| 6,528,140 | B1 | 3/2003 | Kalin et al. | |
| 6,658,766 | B2 | 12/2003 | Kraeuter et al. | |
| D547,933 | S | 8/2007 | Loverin | |
| D547,934 | S | 8/2007 | Loverin | |
| 7,954,257 | B2 | 6/2011 | Banik | |
| 8,307,569 | B2 | 11/2012 | McInnis et al. | |
| 8,424,221 | B2 | 4/2013 | Litchfield et al. | |
| 8,713,817 | B2 | 5/2014 | Litchfield et al. | |
| 2005/0268490 | A1* | 12/2005 | Foxen | A43B 13/181 36/28 |
| 2014/0283413 | A1* | 9/2014 | Christensen | A43B 13/16 36/102 |

OTHER PUBLICATIONS

Image downloaded from https://www.discountnikeshoes.net/images/product_2/7-star-discount-adidas-top-ten-2000-kobe-feet-you-wear-basketball-shoes-white-black-red-258.jpg on May 1, 2018.

Image downloaded from http://only-sneakers.ru/wp-content/uploads/2011/07/adidas-equipment-feet-you-wear_.jpg on May 1, 2018.

Image downloaded from https://www.google.com/search?q=adidas+Originals+CRAZY+BYW+LVL+1+CQ0991+Black+White+Boost+You+Wear+Feet+8+c1&rlz=1C1GGRV_enUS784US784&source=univ&tbm=shop&tbo=u&sa=X&ved=0ahUKEwiA17DzkOXaAhVF9YMKHdHBDH8QsxgIKA&biw=1920&bih=949#sgro=om&spd=14034089241715693256 on May 1, 2018.

Image downloaded from http://www.hadmartiniqueles3s.com/images/pic/Derrick-Rose-Shoes%20318.jpg on May 1, 2018.

Image downloaded from http://blog.blacklotus9.com/blog/wp-content/uploads/2012/01/AdidasTSHeatCheck_Halloween.jpg on May 1, 2018.

* cited by examiner

FOOTWEAR CONSTRUCTION

BACKGROUND OF THE INVENTION

The present invention relates to footwear, and more particularly to a sole assembly for footwear.

There are a variety of footwear constructed for efficient function in different activities. Many footwear are designed to provide a high level of stable support, coupled with impact attenuation upon engagement with an underfoot surface, such as the ground. Much of the support and impact protection afforded by footwear is attributable to the configuration of the sole. The sole protects the foot by dispersing significant forces caused by running, jumping, training and even walking. The sole also provides cushioning that absorbs impact and protects the wearer's appendages, such as their feet, ankles and knees, from the stress associated with strenuous and even day-to-day activities. At the same time, the sole plays a role in helping support the foot in its proper shape to prevent a wearer's feet and legs from becoming fatigued over time.

The objectives of providing adequate impact attenuation and providing support often compete with one another. A highly cushioned sole, designed to compress and efficiently absorb significant impact forces, may not provide sufficient foot support, and this may lead to premature foot fatigue. Such a cushioned sole also might not allow a proper distribution of forces along the bottom of the foot during a gait cycle, which can lead to an erratic torsional, lateral, or lengthwise twisting or rotation of the foot, which can be deleterious to the gait of the wearer. On the other hand, an overly firm sole, designed to provide support and stabilize the foot during the gait cycle, may feel uncomfortable, and may not provide the cushioning needed to protect the wearer against potential damage or injury associated with repeated ground impact. Furthermore, such a sole might be so rigid that it impairs the foot from following its natural flexing and bending form through the gait cycle, which can also alter the wearer's gait in such a way so as to reduce efficiency and energy return.

Accordingly, there is a reason for improving developing footwear sole constructions that provide an appropriate balance between impact attenuation, durability, and support.

SUMMARY OF THE INVENTION

A sole assembly is provided including multiple compression units entrapped in a midsole and adjacent an outsole to efficiently distribute forces and to assist in correct foot motion during a gait cycle.

In one embodiment, multiple compression units are linked to one another to assist the foot in moving through an appropriate foot motion during a gait cycle. For example, a heel compression unit can be linked to an arch compression unit, which can be linked to one or more forefoot compression units, which can be linked to a toe compression unit. The linking of the heel compression unit, the arch compression unit and the forefoot compression unit to one another can resist torsional movement of the units relative to one another, thereby providing a more stable foot support.

In a further embodiment, the heel compression unit, the arch compression unit and the forefoot compression unit can form an integral single piece compression unit body. A main body of the midsole, which may be referred to as a midsole body, can be molded around the compression unit body, with the single piece unit entrapped in the main body. The main body and the single piece unit can function like an integral midsole, while providing the cushioning of the compression units and the structure of the main body for underfoot support and for controlling the compression of the compression units.

In another embodiment, the heel compression unit can be disposed under a calcaneus bone of a wearer, the arch compression unit can be disposed under the cuneiforms, the one or more forefoot compression units can be disposed under the heads of metatarsals, and the toe compression unit can be disposed under the toe bones of the wearer.

In still another embodiment, the main body can be constructed from a first material having a first durometer, and the compression unit body can be constructed from the first material or a different material, and can have a second durometer. The first durometer can be at least 10 durometer points on the Asker C scale greater than the second durometer so that the compression units can compress more and can rebound quicker than the main body of the midsole. Optionally, the first durometer can be 55 Asker C, and the second durometer can be 45 Asker C.

In even another embodiment, the heel compression unit, the arch compression unit, and the first forefoot compression unit can each be generally in the form of an ellipsoid. An upper surface of the respective ellipsoids, and optionally an upper half, can be entrapped in the main body of the midsole. A lower surface of the respective ellipsoids can form at least a portion of the respective heel compression unit lower surface, the arch compression unit lower surface, and the first forefoot compression unit lower surface.

In yet another embodiment, the compression body can include a second forefoot compression unit and the above noted toe compression unit. These additional units can be connected via additional connectors extending between the units.

In a further embodiment, the respective connectors of the compression unit body between compression units can extend upward from the lower surface of the main body to form one or more ridges. These ridges, being part of the compression unit body, can be bordered on opposing sides by the lower surface of the main body. Optionally, the outsole includes respective connector covers that conceal the first respective ridges thereunder, but not the lower surface of the main body on opposing sides of the ridges.

In still a further embodiment, each of the respective compression units can include a compression unit lug. The compression unit lug can be generally centrally located on each respective unit. The compression unit lug can extend from a lower surface of the compression unit a predefined height.

In still yet a further embodiment, the outsole can define a plurality of apertures, for example, in the heel, arch, forefoot and toe regions of the footwear. These apertures can be sized and shaped so that the compression unit lugs in those areas can extend at least partially through the respective apertures. In some cases, the predefined height is greater than a thickness of the outsole in the region around the aperture. In this manner, the lug extends below the outsole ground contacting surface so that the lug can optionally engage the ground before the outsole in that area, providing compression and impact attenuation.

In even a further embodiment, the compression units and the lugs thereof can be disposed under certain bones of the foot to specifically attenuate impact and provide energy return at certain parts of the wearer's gait.

The current embodiments of the footwear herein provide benefits in impact attenuation, foot motion, and energy return that previously have been unachievable. For example, the compression unit body can interact with the main body of the midsole to compress and thereby cushion the foot during different stages of a gait cycle. The linking of the compression units also stabilizes the foot, resisting torsional movement between units. The compression of the softer compression units in a harder midsole main body also assists in storing and returning the associated energy through the compression units to provide a higher degree of energy return.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
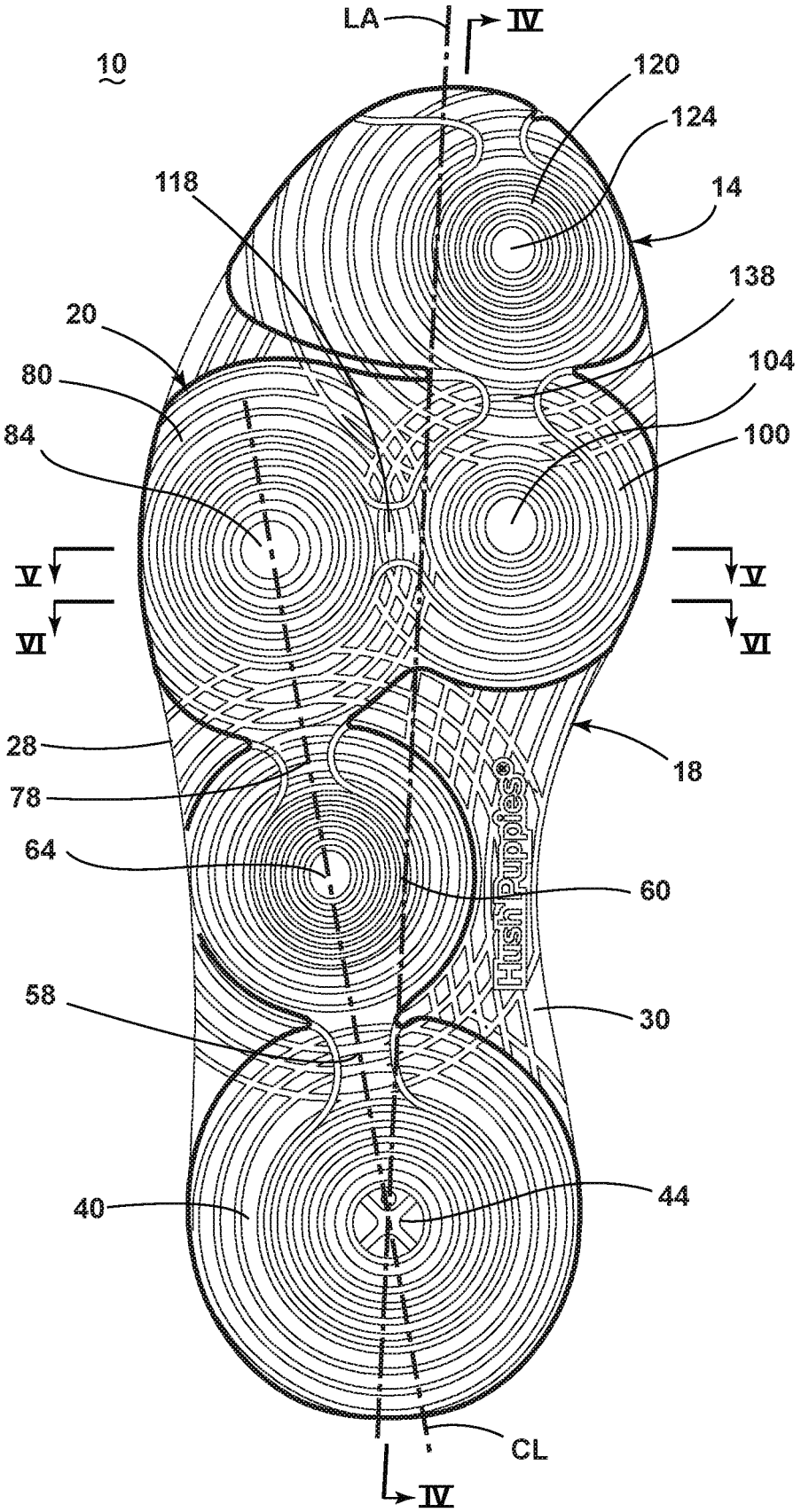
FIG. 1 is a bottom plan view of a current embodiment of the footwear and the sole assembly.

A current embodiment of the footwear is illustrated in FIGS. 1-7, and generally designated 10. In these embodiments, the improved article of footwear includes a sole assembly configured to provide benefits in impact attenuation, foot motion, and energy return.

Although the current embodiment of footwear is illustrated in the context of a performance shoe, it may be incorporated into any type or style of footwear, including casual shoes, trail shoes and boots, hiking shoes, work boots, all-terrain shoes, barefoot running shoes, athletic shoes, running shoes, sneakers, conventional tennis shoes, walking shoes, multisport footwear, boots, dress shoes or any other type of footwear or footwear components. It also should be noted that directional terms, such as "vertical," "horizontal," "top," "bottom," "upper," "lower," "inner," "inwardly," "outer", "outwardly," "below" and "above" are used to assist in describing the embodiments based on the orientation of the embodiments shown in the illustrations.

Further, the terms "medial," "lateral" and "longitudinal" are used in the manner commonly used in connection with footwear. For example, when used in referring to a side of the shoe, the term "medial" refers to the inward side (that is, the side facing the other shoe) and "lateral" refers to the outward side. When used in referring to a direction, the term "longitudinal direction" refers to a direction generally extending along the length of the shoe between toe and heel, and the term "lateral direction" refers to a direction generally extending across the width of the shoe between the medial and lateral sides of the shoe. The use of directional terms should not be interpreted to limit the invention to any specific orientation.

Additionally, as used herein, the term "arch region" (or arch or midfoot) refers generally to the portion of the footwear or sole assembly corresponding to the arch or midfoot of the wearer's foot; the term "forefoot region" (or forefoot) refers generally to the portion of the footwear forward of the arch region corresponding to the forefoot (for example, including the ball and the toes) of a wearer's foot; and the term "heel region" (or heel) refers generally to that portion of the footwear rearward of the arch region corresponding to the heel of the wearer's foot. The forefoot region 22, arch region or midfoot region 24 and heel region 26 generally are identified in FIG. 3. However, it is to be understood that delineation of these regions may vary depending upon the configuration of the sole assembly and/or footwear. Additionally, the sole assembly 14 defines a longitudinal axis LA, shown in FIG. 1, extending from the heel region 26 to the forefoot region 22.

The current embodiments of the footwear 10 can include features that are positioned relative to certain bones in a foot of the wearer. For example, the metatarsals M extend generally in the forefoot region 22 toward the toes T. The metatarsals M can extend into the midfoot region 24, depending on the anatomy of the wearer. The cuneiform bones CB generally are disposed in the midfoot region 24 and form with the metatarsals M a portion of the instep I across the top of the wearer's foot. Rearward of the cuneiform bones CB is the talus TS which extends above the calcaneum or calcaneus bone C. Sometimes, the calcaneus bone C is referred to herein as the heel bone or heel of the wearer's foot.

The footwear 10 can include a textile upper 12 (not shown in full, see FIG. 4) and a sole assembly 14. The upper 12 can be formed from a variety of material elements joined together to cover at least a portion of the wearer's foot. The material elements can be selected based on the intended uses of the article of footwear 10, and can include synthetic textiles, mesh textiles, polymers or leather, for example. The upper 12 is generally constructed to not impede the flexibility of the sole assembly 14, and can include stretchable or elastic material elements. For example, the material elements can include Lycra™, neoprene or spandex, and optionally can be knitted or weaved. The upper 12 can include one or more closure elements, including for example shoelaces or hook and loop fasteners. The upper 12 additionally includes an upper opening for receiving the wearer's foot and a lower periphery for attachment to the sole assembly 14.

Figure 2:
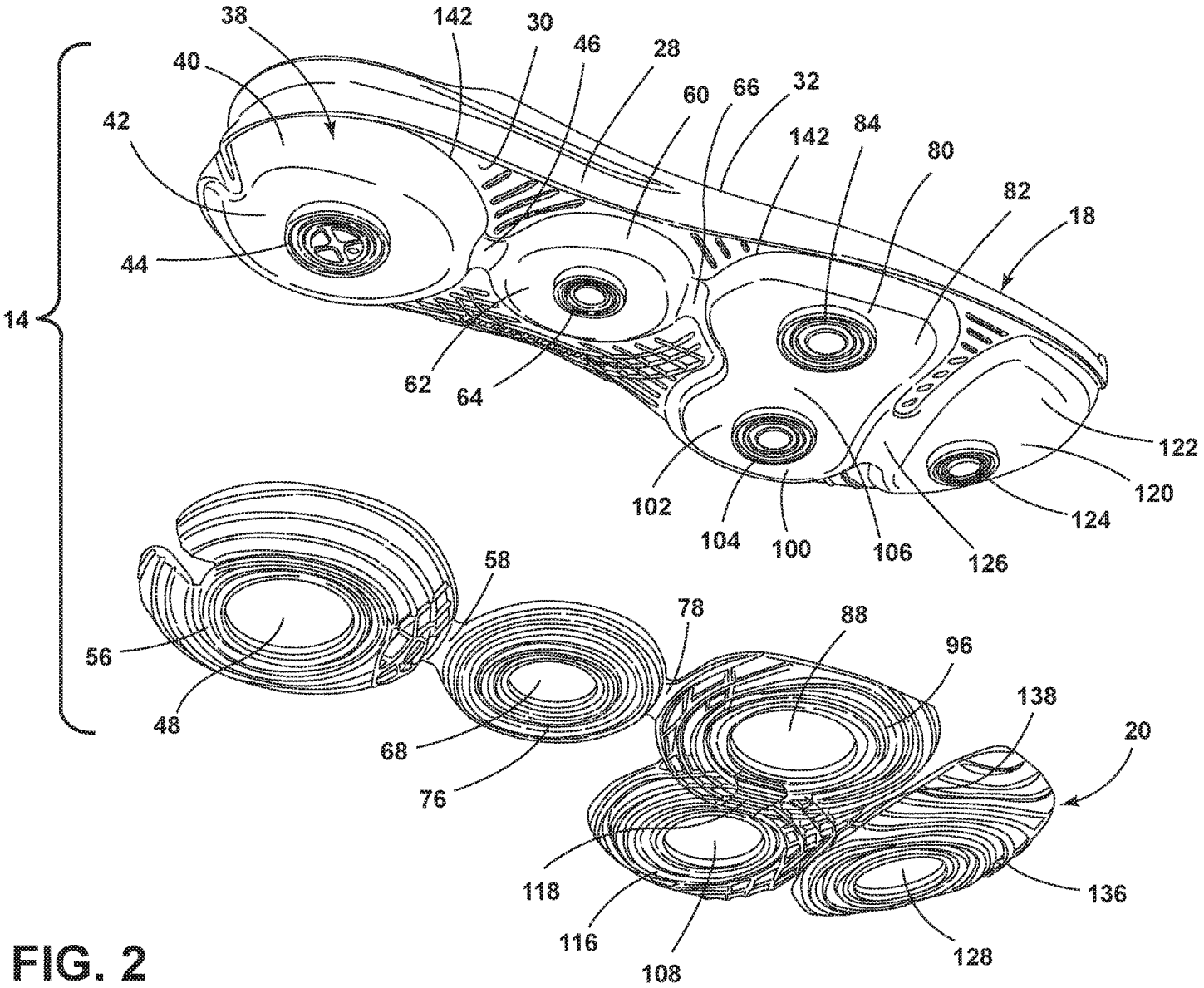
FIG. 2 is an exploded view of an outsole and a midsole of the sole assembly, the midsole including a midsole body and a compression unit body.
Figure 3:
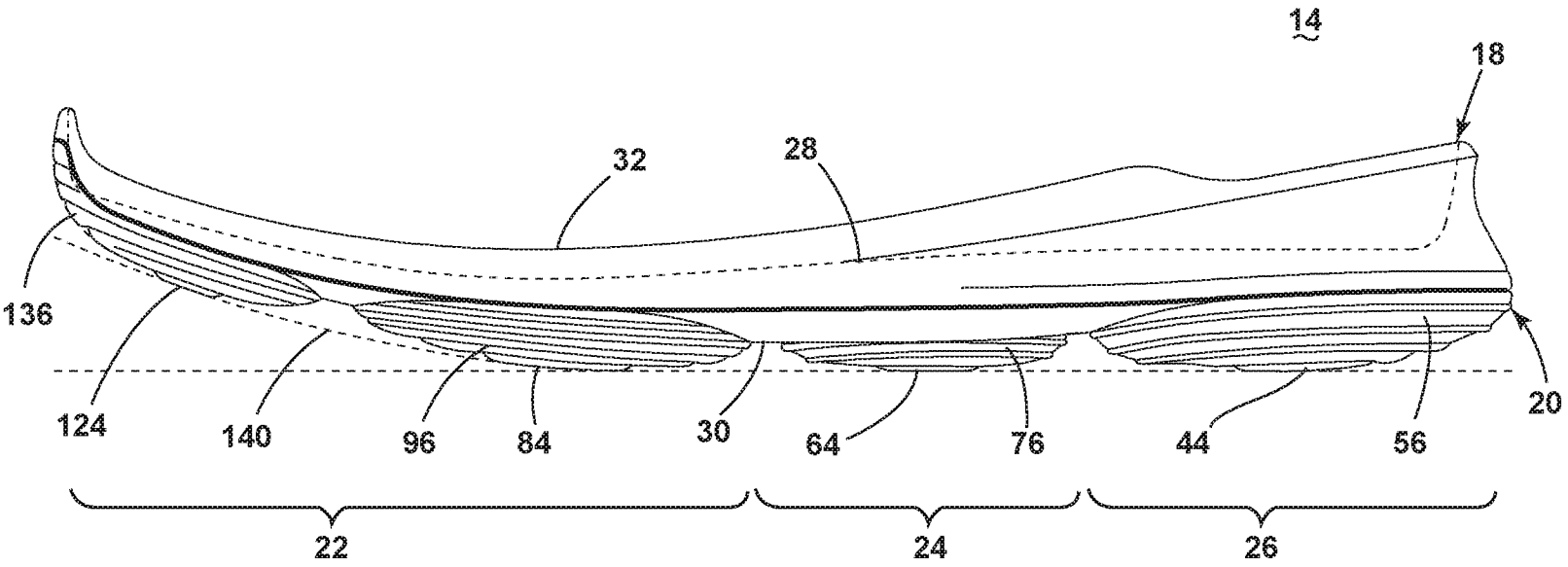
FIG. 3 is a side view of the sole assembly.

As shown in FIGS. 1 and 2, the sole assembly 14 can include a midsole 18 and an outsole 20, but more or fewer elements of the sole assembly 14 can be included in other embodiments. For example, some embodiments can include a footbed, while other embodiments can include only the footbed and an outsole. The sole assembly 14 can include foam with a cushioning top portion and a firmer, wear resistant bottom portion. The components of the sole assembly 14 may individually and/or collectively provide the article of footwear 10 with a number of attributes, such as support, rigidity, flexibility, stability, cushioning, comfort, reduced weight, and/or other attributes.

Referring in particular to FIG. 2, the midsole 18 includes a midsole body 28 including a lower surface 30, and an upper surface 32. The midsole 18 can be constructed from a material having a density that is generally less dense than the density of the outsole 20; for example, ethyl vinyl acetate (EVA), polyurethane (PU), latex, foam, a gel or other materials. Generally, the density of the midsole can be selected so that it compresses relatively easily to provide cushion to the wearer's foot, for example, the heel. The midsole body 28 can be constructed of a first material having a first durometer. As used herein, "durometer" refers to any standard or other suitable durometer measurement (e.g., Asker C or Shore A durometer hardness value) that provides an indication of hardness and/or flexibility of the material. Generally, lower durometer values indicates a softer/more flexible material and higher durometer values indicate a harder/less flexible material.

Figure 7:
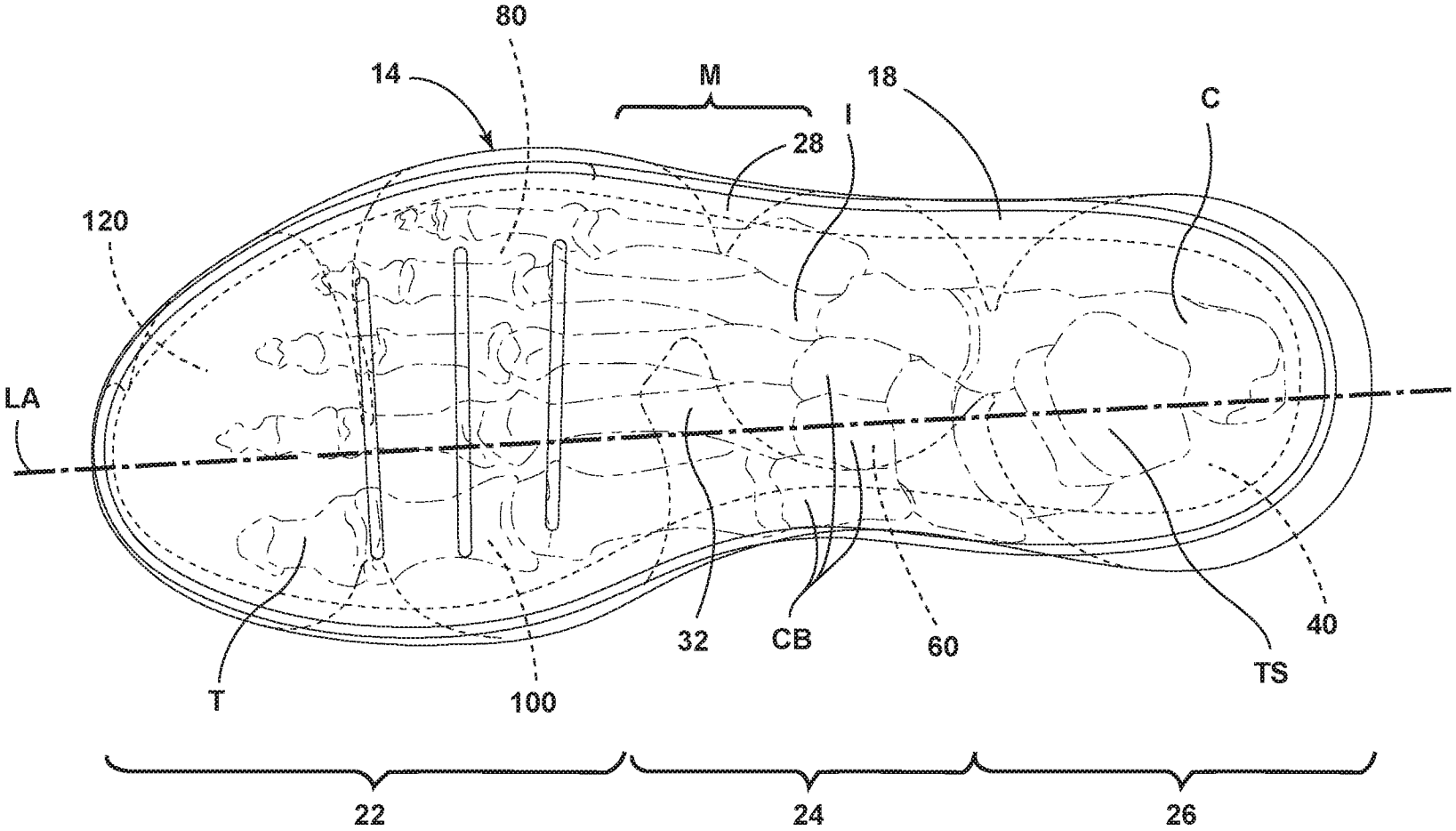
FIG. 7 is a top view of the sole assembly illustrating the embedded compression units in the midsole body.

The midsole 18 includes a compression unit body 38 that defines multiple compression units linked to one another via respective connecting members. The compression unit body 38 includes a heel compression unit 40, an arch compression unit 60, and a first forefoot compression unit 80. Referring to FIG. 7, the heel compression unit 40 is configured to be positioned under a calcaneus bone C of a wearer, the arch compression unit 60 is configured to be positioned under a cuneiform bone CB of the wearer, and the first forefoot compression 60 unit is configured to be positioned under at least one metatarsal M head of the foot.

The heel compression unit 40 includes a heel compression unit lower surface 42 having a heel compression unit lug 44 projecting from the lower surface 42. The heel compression unit 40 is linked via a first connector 46 to the arch compression unit 60. The arch compression unit includes an arch compression unit lower surface 62 having an arch compression unit lug 64 projecting from the lower surface 62. The arch compression unit 60 is linked via a second connector 66 to the first forefoot compression unit 80. The first forefoot compression unit 80 includes a first forefoot compression unit lower surface 62 having a first forefoot compression unit lug 84 projecting from the lower surface 82. The lugs 44, 64, 84 are generally circular in cross section, though other shapes are contemplated herein, and can be generally centrally located on each respective compression unit 40, 60, 80. Each of the heel compression unit 40, the arch compression unit 60, and the first forefoot compression unit 80 can include an annular groove 50, 70, 90 on a lower surface of their respective lugs 44, 64, 84. The grooves 50, 70, 90 increase the compressibility of the lugs 44, 64, 84, which can further diffuse the ground impact force and aid in the cushioning effect. Further, the compression unit lugs 44, 64, 84 can extend from the lower surface 42, 62, 82 of the compression units 40, 60, 80 a predefined height. As a non-limiting example, the compression unit lugs 44, 66, 84 can extend 0.5 mm from the lower surface 42, 62, 82, optionally about 0.5 mm to 1.0 mm, and even further optionally at least 1.0 mm.

The heel compression unit 40, the first connector 46, the arch compression unit 60, the second connector 66, and the first forefoot compression unit 80 can be a unitary, integrally molded structure constructed from the first material or a different material. Even when constructed from the first material, the compression unit body 38 can have a second durometer which is less than the first durometer. The first durometer can optionally be at least 10 durometer points on the Asker C scale greater than the second durometer, further optionally between 10 and 20 durometer points greater, and even further optionally about 20 durometer points greater. As a non-limiting example, the midsole body 28 can have a durometer of about 55 Asker C and the second durometer can be about 45 Asker C. The first durometer can be optionally 45 to about 65 Asker C and the compression unit body 38 can have a durometer of optionally 35 to about 55 Asker C, or further optionally 25 to about 35 Asker C. The midsole body 28 can be "harder" than the compression unit body 38 so that the compression units 40, 60, 80 provide zonal cushioning in the heel and/or on the ball of the foot as discussed in further detail below.

Figure 4:
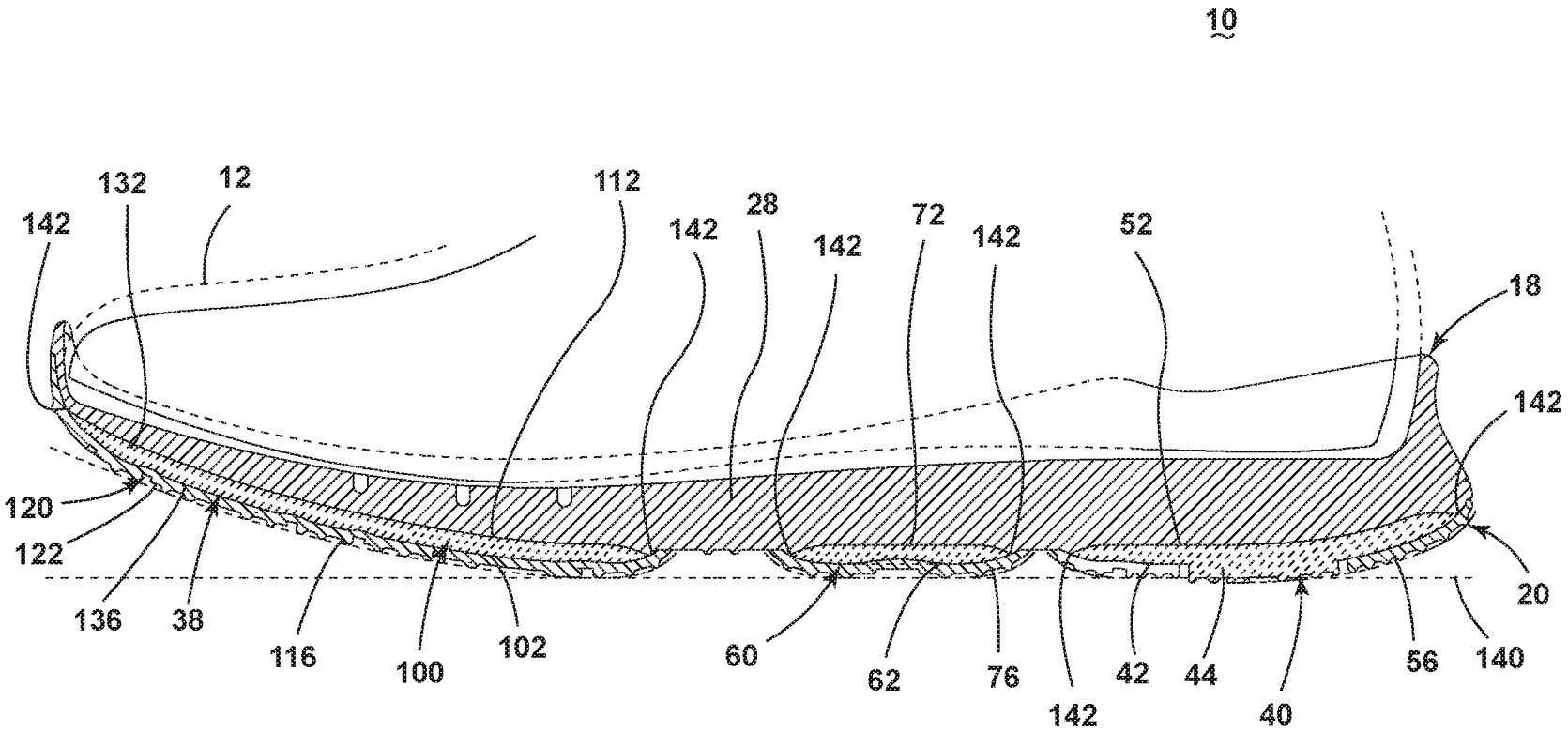
FIG. 4 is a section view of the sole assembly taken along line IV-IV in FIG. 1.
Figure 6:
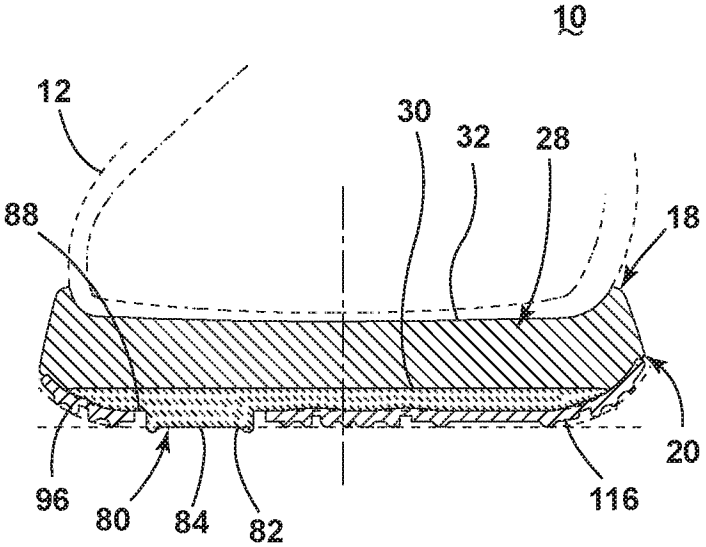
FIG. 6 is a section view of the sole assembly taken along line VI-VI in FIG. 1.

The heel compression unit 40, the arch compression unit 60, and the first forefoot compression unit 80 can each be generally ellipsoid in shape. It should be understood that the ellipsoid shape, as used herein, of the compression units can be, at least in part, flattened, partially planar, broken, uneven, and/or interrupted, and should not be regarded as so limiting. The heel compression unit 40, the arch compression unit 60, and the first forefoot compression unit 80 each include a respective upper surface 52, 72, 92 and a lower surface 42, 62, 82. The upper surfaces 52, 72, 92 of the ellipsoids can be entrapped in the midsole body 28 and disposed below the upper surface 32 of the midsole body 28, as illustrated in FIG. 4. Optionally, an upper half of the ellipsoid can be entrapped in the midsole body 28. The lower surface of each of the ellipsoids can form at least a portion of the lower surface 42, 62, 82 of each of the respective compression units 40, 60, 80. It should be understood that the lower surfaces 42, 62, 82 can include the curved "sides" of the ellipsoid, and is not limited to the lowest extent surface of the compression units 40, 60, 80.

The first connector 46 extends upward from the lower surface 42 of the heel compression unit 40 to form a first ridge bordered on opposing sides by the lower surface 30 of the midsole body 28. In a similar manner, the second connector 66 extends upward from the lower surface 62 of the arch compression unit 60 to form a second ridge bordered on opposing sides by the lower surface 30 of the midsole body 28.

Figure 5:
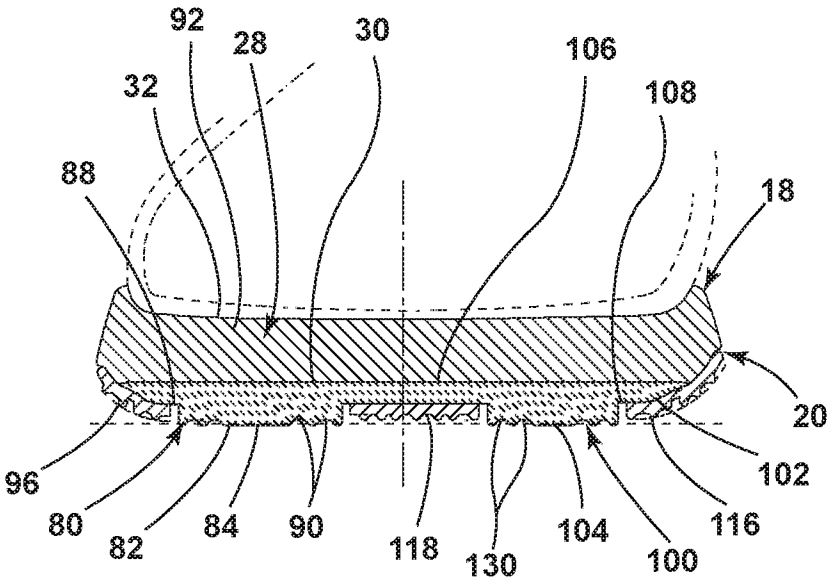
FIG. 5 is a section view of the sole assembly taken along line V-V in FIG. 1.

Referring to FIGS. 4 and 5, the midsole body 28 defines a first thickness between the first forefoot compression unit 80 upper portion or surface 92 and the upper surface 32 of the midsole body 28. The first forefoot compression unit 80 defines a second thickness between the first forefoot compression unit 80 upper portion 92 and the lower surface 82 of the first forefoot compression unit 80. The arch compression unit 60 defines a third thickness between the arch compression unit 60 upper portion 72 and the lower surface 62 of the arch compression unit 60. The ratio of the second thickness relative to the first thickness can optionally be at least 1.1:1, further optionally between 1.3:1 and 1.8:1, and even further optionally about 1.8:1. The ratio of the first thickness relative to the third thickness can be optionally at least 2:1, further optionally between 2.1:1 and 2.8:1,and even further optionally about 2.8:1.

Referring back to FIG. 2, the sole assembly 14 includes the outsole 20 which is joined with the midsole body 28 and the compression unit body 38. The outsole 20 includes a substantially dome shaped heel cover 56 that is disposed over and covers the heel compression unit 40 and includes an outsole heel aperture 48 defined in and through the outsole 20; a substantially dome shaped arch cover 76 that covers the arch compression unit 60 and includes an outsole arch aperture 68; and a substantially dome shaped first forefoot cover 96 that covers the first forefoot compression unit 80 and includes an outsole first forefoot aperture 88. The covers are linked to one another. For example, the heel cover 56 is linked via a first connector cover 58 to the arch cover 76, and the arch cover 76 is linked via a second connector cover 78 to the first forefoot cover 96. Further, the outsole 20 has a lower surface that defines a ground contacting surface 140. The outsole 20 can be secured to the midsole 18 in any conventional manner, for example with adhesives, cement, injection molding, pour molding or any other technique used to join an outsole and a midsole.

The apertures 48, 68, 88 can be sized and shaped so that the compression unit lugs 40, 60, 80 in those areas can extend at least partially through the respective apertures. In some cases, the predefined height is greater than a thickness of the outsole 20 in the region around the aperture 48, 68, 88. In this manner, the lug 44, 64, 84 extends below the ground contacting surface 140 of the outsole 20 so that the lug 44, 64, 84 can optionally engage the ground before the outsole 20 in that area, providing compression and impact attenuation.

The outsole 20 can include multiple grooves and/or ridges arranged as desired, and not necessarily in a repeating pattern. The grooves and ridges can include one or more geometric shapes. The outsole 20 can be constructed from a material suitable for providing a durable and non-slip wear surface. For example, natural or synthetic rubber, thermoplastic polyurethane elastomers (TPU), nylon, polymer blends, wear resistant polymers, elastomers and/or other materials and combinations thereof. The outsole material can have a relatively high durometer, greater than the first and second durometers of the midsole 18.

Referring to FIGS. 3-6, with the outsole 20 joined to the compression unit body 28, the lugs are configured to align with and extend substantially through apertures in the outsole 20 to form the ground contacting surface 140. The heel lug 44 extends through the outsole heel aperture 48, the arch lug 64 extends through the outsole arch aperture 68, and the first forefoot lug 84 extends through the outsole first forefoot aperture 88. The lugs 44, 64, 84 extend below the ground contacting surface 140 of the outsole 20. The heel compression unit lower surface 42, the arch compression unit lower surface 62, and the first forefoot compression unit lower surface 82 each interrupt and extend below the lower surface 30 of the midsole body 28 when the midsole 18 and outsole 20 are in an unloaded state. It should be understood that the unloaded state refers to the footwear with no weight of the wearer applied. The loaded state is a result of the wearer's weight and contact of the sole assembly 14 with a ground surface.

The lower surface 30 of the midsole body 28 intersects the first forefoot compression unit 80 lower surface 82 at a boundary 142. Likewise, the lower surface 30 of the midsole body 28 intersects the lower surfaces 42, 62 of the heel compression unit 40 and the arch compression unit 60 at the boundary 142. The boundary 142 also extends along the intersection of the lower surface of the midsole body 28 and the first and second connectors 46, 66 of the compression unit body 38. This boundary 142, on the lower surface 30 of the midsole body 28 around the intersection of the midsole body 28 and the compression unit body 38, however, is concealed by the outsole 20. Further, the first connector cover 58 of the outsole 20 conceals the first connector 46 of the compression unit body 38 thereunder, but not the lower surface 30 of the midsole body 28 on opposing sides thereof. The second connector cover 78 of the outsole 20 conceals the second connector 66 of the compression unit body 38 thereunder, but not the lower surface 30 of the midsole body 28 on opposing sides thereof. Accordingly, the boundary 142 is concealed by the outsole 20, while the remainder of the lower surface 30 of the midsole body 28 remains visible.

The footwear 10 provides benefits in impact attenuation, foot motion, and energy return that previously have been unachievable. For example, the compression unit body 38 can interact with the midsole body 28 to compress and thereby cushion the foot during different stages of a wearer's gait cycle. The linking of the compression units 40, 60, 80 also stabilizes the foot, by resisting torsional movement between units. The linking of the heel compression unit 40, the arch compression unit 60, and the forefoot compression unit 80 to one another can resist torsional movement of the units between one another, thereby providing a more stable foot support. The compression of the softer compression units 40, 60, 80 in a harder midsole body 28 also assists in storing and returning the associated energy through the compression units 40, 60, 80 to provide a higher degree of energy return.

The compression units 40, 60, 80 and the lugs 44, 64, 84 thereof can be disposed under certain bones of the foot to specifically attenuate impact and provide energy return at certain parts of the wearer's gait. The compression units 40, 60, 80 are configured to aid in compression of the lugs 44, 64, 84 so that a bottom surface of each lug 44, 64, 84 is flush with the ground contacting surface 140 of the outsole 20 when the midsole 18 and the outsole 20 are in a loaded state. The impact force caused by the footwear impacting the ground is transferred to the outsole 20 of the footwear. Because the lugs 44, 64, 84 extend below the lower surface of the outsole 20, part of the impact force is absorbed by the lugs 44, 64, 84. Upon this transfer of the impact force to the lugs 44, 64, 84 and the lower surface of the outsole 20, the force is transferred to and diffused by the compression units 40, 60, 80. By virtue of the mechanical interface between the compression units 40, 60, 80 and the heel, arch, and first forefoot covers 56, 76, 96 of the outsole 20, namely the thinning of the entrapped compression units 40, 60, 80, a portion of the impact force is transferred from the compression units 40, 60, 80 to the relatively harder midsole body 38. In effect, the resulting forces transferred to the heel, arch, and ball of the foot are only a portion of the initial impact forces, which reduces the overall shock and impact to the foot of the wearer.

Additionally, the relative difference in durometer of the compression unit body 38 and the midsole body 28 provide that the heel, arch, and first forefoot compression units 40, 60, 80 can rebound quicker than the midsole body 28. The effect of this is to provide increased energy return to the midsole 18 from the wearer's stride by reducing the amount of energy lost by the footwear. The lower durometer material used for the compression unit body 38 deflects more than the material of the midsole body 28, compressing the compression unit body 38 between the harder outsole 20 and the relatively harder midsole body 28 to spread out the impact force across the sole of the wearer's foot. When the sole assembly 14 is compressed between the foot and the ground surface, the compression unit body 38 exerts an upward force on the lower surface 30 of the midsole body 28, and, depending on the compressive force, can deflect and/or compress the midsole body 28. The compression unit body 38, and perhaps the midsole body 28, deforms with each foot strike, and absorbs and stores the kinetic energy produced when the foot hits the ground. The midsole 18 then returns the stored energy to the wearer as the foot leaves the ground. The lower durometer material used for the compression unit body 38 stores the energy of that compression better and returns to the original shape more quickly, providing a responsive feel as it pushes back on the bottom of the wearer's foot during push off. The different in durometer of material for the midsole body 28 and compression unit body 38 combine the softness of cushioned footwear with the powerful, quick turnover of responsive footwear.

The sole assembly 14 also provides stability to the foot. The heel compression unit lug 44, the arch compression unit lug 64, and the first forefoot compression unit lug 84 each include a center, with each center aligned along a common line CL, shown in FIG. 1. Additionally, as described above, the compression units 40, 60, 80 include linking first and second connectors 46, 66 therebetween to assist the foot in moving through an appropriate foot motion during a gait cycle. The linking of the heel compression unit 40, the arch compression unit 60, and the forefoot compression unit 80 to one another along that common line can help resist torsional movement of the units between one another, thereby providing a more stable foot support. With this arrangement, the first and second connectors 46, 66 provide support and stiffness along and/or generally parallel to the longitudinal axis LA of the footwear 10.

Optionally, the midsole 18 can include a second forefoot compression unit 100. The second forefoot compression unit 100 includes a second forefoot compression unit lower surface 102 with a second forefoot compression unit lug 104 projecting from the second lower surface 102. The second forefoot compression unit 100 can be linked via a third connector 106 to the first forefoot compression unit 80. As described above, the lug 104 can extend through a second forefoot aperture 108 defined by the outsole 20, extending below the ground contacting surface 140 of the outsole 20. Similar to that described above, the lug 104 can include groove(s) 110 on the lower surface of the lug 104. Further, the outsole 20 includes a substantially dome shaped second forefoot cover 116 that covers the second forefoot compression unit 100, and is linked to the first forefoot cover 96 via a second forefoot connector cover 118.

In this exemplary arrangement, the first forefoot compression unit lug 84 can be disposed on a lateral side of the longitudinal axis LA of the footwear 10 and the second forefoot compression unit lug 104 can be disposed on a medial side of a longitudinal axis LA of the footwear 10. The first forefoot compression unit 80 can be configured to be positioned under at least one of the wearer's foot's fourth and fifth metatarsal head, while the second forefoot compression unit 100 can be configured to be positioned under at least one of the first and second metatarsal heads. The second forefoot compression unit 100 can be constructed from the first material or a different material, and can have a second durometer.

Further optionally, the midsole 18 can include a toe compression unit 120. The toe compression unit 120 can include a toe compression unit lower surface 122 with a toe compression unit lug 124 projecting from the lower surface 122. The toe compression unit 120 can be linked via a fourth connector 126 to the second forefoot compression unit 100. The lug 124 can extend through a toe aperture 128 defined by the outsole 20, extending below the ground contacting surface 140 of the outsole 20. Similar to that described above, the lug 124 can include groove(s) 100 on the lower surface of the lug 124. Further, the outsole 20 can include a substantially dome shaped toe cover 136 that covers the toe compression unit 120, and may be linked to the second forefoot cover 116 via a toe connector cover 138.

Manufacture of the footwear 10 will now be described. The upper 12 is manufactured using generally conventional techniques and apparatus. The bottom of a textile upper 12 can be closed by a Stroble or other suitable construction.

The midsole body 28 can be formed by injection or pour molding the first material, with a first density, into a mold shaped to correspond to the features of the midsole 18, including the upper and lower surfaces 32, 30. The mold can optionally be contoured to include recesses complementary to the compression unit body 38 formed in the desired regions of the midsole body 28, and more specifically in the lower surface 30 of the midsole body 28. As desired, other operations, such as trimming and drilling, can be performed on the midsole body 28 as well.

The compression unit body 38 can be formed by injection or pour molding the first material or a different material, with a second density, into a mold shaped to correspond to the features of the compression unit body 38, including the heel, arch, and first forefoot compression units 40, 60, 80, the respective lugs 44, 64, 84 and their grooves 50, 70, 90, as well as the second forefoot and toe compression units 100, 120, lugs 104, 124, and grooves 110, 130 if included. The compression unit body 38 can be molded with the midsole body 28. The compression unit body 38 can be molded directly in the midsole body 28, or the midsole body 28 can be molded around the compression unit body 38. Alternatively, the compression unit body 38 and midsole body 28 can be co-molded in a common mold. Insert molding and co-molding can form a unitary midsole 18. Insert molding and co-molding can permanently couple the midsole body 28 and the compression unit body 38. Co-molding can permanently couple the components, while at the same time molding the midsole body 28 and compression unit body 38 into the desired shape. Further alternatively, the compression unit body 38 can be molded separately and adhered via any suitable means to the midsole body 28.

The outsole 20 can be injection molded or pour molded from a hard, durable material, such as rubber, using conventional molding apparatus and techniques. The pattern of grooves and/or ridges on the lower surface of the outsole 20 and the outsole apertures 48, 68, 88, 108, 128 defined by the outsole 20 can be formed during the molding operation. Optionally, these features, as well as any contours or shapes of the outsole components, can be cut through or in the outsole 20 after the outsole is formed. It is noted that the apertures 48, 68, 88, 108, 128 can be molded or cut so that they align with the lugs 44, 64, 84, 104, 124 of the compression units. The outsole 20 can be secured to the midsole 18 with cement, adhesive, or other attachment devices. The outsole components can be trimmed as desired to ensure a clean and flush fit with the upper and/or midsole as well.

The upper 20 can be joined with the midsole 18 and/or outsole 20. This can be accomplished by adhering these components together or using any other suitable means for affixing the components together.

Optionally, in the co-molding of the midsole body 28 and compression unit body 38, the respective materials can engage and interface along the boundary 142, which is the interface between the lower surface 30 of the midsole body 28 and the lower surface of the compression unit 38. When molding the components, the two materials may bleed onto one another, creating a sloppy, uneven boundary line. This sloppy intersection is more obvious when the midsole body 28 and compression unit body 38 are molded of different color material. The outsole 20 can cover and conceal this boundary 142, while the remainder of the lower surface 30 of the midsole body 28 can remain visible.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. A footwear comprising:

an upper;

a midsole joined with the upper, the midsole including a midsole body including an upper surface and a lower surface, the midsole body being constructed from a first material having a first durometer;

a plurality of compression units linked to one another via respective connecting members, the plurality of compression units including a heel compression unit configured to be positioned under a calcaneus bone of a wearer, the heel compression unit including a heel compression unit lower surface having a heel compression unit lug projecting from the heel compression unit lower surface, the heel compression unit linked via a first connector to an arch compression unit configured to be positioned under a cuneiform bone of a wearer, the arch compression unit including an arch compression unit lower surface having an arch compression unit lug projecting from the arch compression unit lower surface, the arch compression unit linked via a second connector to a first forefoot compression unit including a first forefoot compression unit lower surface having a first forefoot compression unit lug projecting from the first forefoot compression unit lower surface, the heel compression unit, the first connector, the arch compression unit, the second connector and the first forefoot compression unit being constructed from the first material but having a second durometer less than the first durometer; and an outsole joined with the midsole body and the plurality of compression units so that the heel compression unit lug extends through an outsole heel aperture defined by the outsole and is adjacent a ground contacting surface of the outsole, so that the arch compression unit lug extends through an outsole arch aperture defined by the outsole and is adjacent the ground contacting surface of the outsole, and so that the first forefoot compression unit lug extends through an outsole first forefoot aperture defined by the outsole and is adjacent the ground contacting surface of the outsole, wherein the heel compression unit lower surface, the arch compression unit lower surface, and the first forefoot compression unit lower surface each interrupt and extend below the lower surface of the midsole body when the midsole and outsole are in an unloaded state, whereby the linking of the heel compression unit, the arch compression unit and the forefoot compression unit to one another resists torsional movement of the plurality of units between one another.

2. The footwear of claim 1, wherein the first durometer is at least 10 durometer points on the Asker C scale greater than the second durometer so that the plurality of compression units can rebound quicker than the midsole body.

3. The footwear of claim 2, wherein the heel compression unit, the arch compression unit and the first forefoot compression unit are generally each in the shape of an ellipsoid, with an upper surface of the ellipsoid entrapped in the midsole body, and a lower surface of the ellipsoid forming at least a portion of the respective heel compression unit lower surface, the arch compression unit lower surface and the first forefoot compression unit lower surface.

4. The footwear of claim 3, wherein the heel compression unit lug is generally circular in shape and defines an annular groove configured to aid in compression of the heel compression unit lug so that a bottom surface of the heel compression unit lug is flush with the ground contacting surface of the outsole when the midsole and the outsole are in a loaded state.

5. The footwear of claim 4, comprising:

a second forefoot compression unit including a second forefoot compression unit lower surface having a second forefoot compression unit lug projecting from the second forefoot compression unit lower surface, the second forefoot compression unit being constructed from the first material but having the second durometer, the second forefoot compression unit linked via a third connector to the first forefoot compression unit, the second forefoot compression unit lug extending through an outsole second forefoot aperture defined by the outsole, extending below the ground contacting surface of the outsole, wherein the first forefoot compression unit lug is disposed on a lateral side of a longitudinal axis of the footwear and the second forefoot compression unit lug is disposed on a medial side of a longitudinal axis of the footwear.

6. The footwear of claim 5, wherein the first forefoot compression unit is configured to be positioned under at least one of a fourth and fifth metatarsal head and the second forefoot compression unit is configured to be positioned under at least one of a first and second metatarsal head.

7. The footwear of claim 6, wherein the lower surface of the midsole body intersects the first forefoot compression unit lower surface at a boundary, wherein the boundary is concealed by the outsole, wherein the outsole is disposed over the first forefoot compression unit lower surface is of a dome shape.

8. The footwear of claim 1, wherein the heel compression unit, the arch compression unit and the first forefoot compression unit are generally each in the shape of an ellipsoid, with an upper surface of the ellipsoid entrapped in and engaged by the midsole body, and a lower surface of the ellipsoid forming at least a portion of the respective heel compression unit lower surface, the arch compression unit lower surface and the first forefoot compression unit lower surface.

9. The footwear of claim 1, comprising:

a second forefoot compression unit including a second forefoot compression unit lower surface having a second forefoot compression unit lug projecting from the second forefoot compression unit lower surface, the second forefoot compression unit linked via a third connector to the first forefoot compression unit, the second forefoot compression unit lug extending through an outsole second forefoot aperture defined by the outsole, extending below the ground contacting surface of the outsole; and a toe compression unit including a toe compression unit lower surface having a toe compression unit lug projecting from the toe compression unit lower surface, the toe compression unit linked via a fourth connector to the second forefoot compression unit, the toe compression unit lug extending through an outsole toe aperture defined by the outsole, extending below the ground contacting surface of the outsole.

10. The footwear of claim 1, wherein the first connector extends upward from the lower surface of the heel compression unit to form a first ridge bordered on opposing sides by the lower surface of the midsole body, wherein the second connector extends upward from the lower surface of the arch compression unit to form a second ridge bordered on opposing sides by the lower surface of the midsole body, wherein the outsole includes a first connector cover that conceals the first ridge thereunder but not the lower surface of the midsole body on opposing sides thereof, wherein the outsole includes a second connector cover that conceals the second ridge thereunder but not the lower surface of the midsole body on opposing sides thereof.

11. A footwear comprising:

an upper;

a midsole joined with the upper, the midsole including a midsole body including an upper surface and a lower surface;

a heel compression unit configured to be positioned under a calcaneus bone of a wearer, the heel compression unit including a heel compression unit lower surface having a heel compression unit lug projecting from the heel compression unit lower surface, and a heel compression unit upper portion that is disposed below the upper surface of the midsole body;

an arch compression unit configured to be positioned under a cuneiform bone of a wearer, the arch compression unit including an arch compression unit lower surface having an arch compression unit lug projecting from the arch compression unit lower surface, and an arch compression unit upper portion that is disposed below the upper surface of the midsole body;

a first forefoot compression unit including a first forefoot compression unit lower surface having a first forefoot compression unit lug projecting from the first forefoot compression unit lower surface, and a first forefoot compression unit upper portion that is disposed below the upper surface of the midsole body; and an outsole joined with the midsole body so that the heel compression unit lug extends through an outsole heel aperture defined by the outsole and is adjacent a ground contacting surface of the outsole, so that the arch compression unit lug extends through an outsole arch aperture defined by the outsole and is adjacent the ground contacting surface of the outsole, and so that the first forefoot compression unit lug extends through an outsole first forefoot aperture defined by the outsole and is adjacent the ground contacting surface of the outsole, wherein the heel compression unit lower surface, the arch compression unit lower surface, and the first forefoot compression unit lower surface each interrupt and extend below the lower surface of the midsole body when the midsole and outsole are in an unloaded state.

12. The footwear of claim 11, wherein the midsole body defines a first thickness between the first forefoot compression unit upper portion and the upper surface of the midsole body, wherein the first forefoot compression unit defines a second thickness between the first forefoot compression unit upper portion and the lower surface of the first forefoot compression unit, wherein a ratio of the second thickness to the first thickness is at least 1.1:1.

13. The footwear of claim 12, wherein the arch compression unit defines a third thickness between the arch compression unit upper portion and the lower surface of the arch compression unit, wherein a ratio of the first thickness to the third thickness is at least 2:1.

14. The footwear of claim 11, wherein the heel compression unit lug, the arch compression unit lug and the first forefoot compression unit lug each include a center, with each center aligned along a common line, wherein the heel compression unit is linked to the arch compression unit with a first connector, wherein the arch compression unit is linked to the first forefoot compression unit with a second connector.

15. The footwear of claim 11, wherein the midsole body has a first durometer, wherein the heel, arch and first forefoot compression units have a second durometer, wherein the first durometer is at least 10 durometer points on the Asker C scale greater than the second durometer so that the heel, arch and first forefoot compression units can rebound quicker than the midsole body.

16. The footwear of claim 15, wherein the heel compression unit, the arch compression unit and the first forefoot compression unit are generally each in the shape of an ellipsoid, with an upper surface of the ellipsoid entrapped in the midsole body, and a lower surface of the ellipsoid forming at least a portion of the respective heel compression unit lower surface, the arch compression unit lower surface and the first forefoot compression unit lower surface.

17. A footwear comprising:

an upper;

a midsole joined with the upper, the midsole including a midsole body including an upper surface and a lower surface, the midsole body constructed of a first material having a first durometer;

a compression unit body at least partially embedded in the lower surface, the compression unit body constructed from the first material but having a durometer that is less than the first durometer, the compression unit body including a heel compression unit configured to be positioned under a calcaneus bone of a wearer, the heel compression unit linked via a first connector to an arch compression unit configured to be positioned under a cuneiform bone of a wearer, the arch compression unit linked via a second connector to a first forefoot compression unit, the heel compression unit, the first connector, the arch compression unit, the second connector and the first forefoot compression unit being an integral single piece unit; and an outsole joined with the midsole body, the outsole including a dome shaped heel cover that at least partially covers the heel compression unit, a dome shaped arch cover that at least partially covers the arch compression unit and a dome shaped first forefoot cover that at least partially covers the first compression unit forefoot unit, whereby the linking of the heel compression unit, the arch compression unit and the forefoot compression unit to one another resists torsional movement of the plurality of units between one another.

18. The footwear of claim 17, comprising:

a second forefoot compression unit including a second forefoot compression unit lower surface having a second forefoot compression unit lug projecting from the second forefoot compression unit lower surface, the second forefoot compression unit linked via a third connector to the first forefoot compression unit, the second forefoot compression unit lug extending through an outsole second forefoot aperture defined by the outsole, extending adjacent the ground contacting surface of the outsole; and a toe compression unit including a toe compression unit lower surface having a toe compression unit lug projecting from the toe compression unit lower surface, the toe compression unit linked via a fourth connector to the second forefoot compression unit, the toe compression unit lug extending through an outsole toe aperture defined by the outsole, extending adjacent the ground contacting surface of the outsole.

19. The footwear of claim 18, wherein the first connector extends upward from the lower surface of the heel compression unit to form a first ridge bordered on opposing sides by the lower surface or the midsole body, wherein the second connector extends upward from the lower surface of the arch compression unit to form a second ridge bordered on opposing sides by the lower surface of the midsole body, wherein the outsole includes a first connector cover that conceals the first ridge thereunder but not the lower surface of the midsole body on opposing sides thereof, wherein the outsole includes a second connector cover that conceals the second ridge thereunder but not the lower surface of the midsole body on opposing sides thereof.

20. The footwear of claim 19, wherein the lower surface of the midsole body intersects the compression unit body at a boundary, wherein the boundary is concealed by the outsole.

* * * * *